US009821442B2

(12) United States Patent
Campbell

(10) Patent No.: US 9,821,442 B2
(45) Date of Patent: Nov. 21, 2017

(54) METHODS AND APPARATUS FOR AN ENHANCED DRIVING BIT

(71) Applicant: Bryce Fastener Company, Inc., Gilbert, AZ (US)

(72) Inventor: Richard Bryce Campbell, Gilbert, AZ (US)

(73) Assignee: Bryce Fastener Company, Inc., Gilbert, AZ (US)

( * ) Notice: Subject to any disclaimer, the term of this patent is extended or adjusted under 35 U.S.C. 154(b) by 277 days.

(21) Appl. No.: 14/886,356

(22) Filed: Oct. 19, 2015

(65) Prior Publication Data

US 2017/0106507 A1 Apr. 20, 2017

(51) Int. Cl.
*B25B 15/00* (2006.01)
*B21H 7/00* (2006.01)

(52) U.S. Cl.
CPC ..... *B25B 15/005* (2013.01); *B21H 7/00* (2013.01)

(58) Field of Classification Search
CPC ..... B25B 15/005; B25B 15/004; B25B 15/00
See application file for complete search history.

(56) References Cited

U.S. PATENT DOCUMENTS 2,285,461 A 5/1939 Purtell
2,638,019 A 5/1953 Stellin
2,813,450 A 11/1957 Dzus
3,241,408 A 3/1966 McCauley
5,435,680 A 7/1995 Schuster
5,553,983 A * 9/1996 Shinjo ..... B25B 15/005 411/404
6,199,455 B1 3/2001 Wagner
8,291,795 B2 * 10/2012 Hughes ..... B25B 15/005 411/404
9,422,965 B2 * 8/2016 Campbell, II ..... F16B 23/003
2011/0217143 A1 * 9/2011 Hughes ..... B25B 15/005 411/407
2013/0340578 A1 12/2013 Lai
2014/0150613 A1 6/2014 Kozak

FOREIGN PATENT DOCUMENTS

GB 837889 A 6/1960

* cited by examiner

*Primary Examiner* — David B Thomas
(74) *Attorney, Agent, or Firm* — The Noblitt Group, PLLC

(57) ABSTRACT

Methods and apparatus for an enhanced driving bit according to various aspects of the present technology include a bit comprising a plurality of driving surfaces having a limited length and a shoulder portion positioned between the driving surfaces and a mid-body portion of the bit. The length of the driving surfaces is selected to allow complete insertion into a recessed socket area of a fastener such that the entire driving surface is positioned within the recessed socket area. The shoulder surface is configured to distribute localized stresses away from the driving surfaces to the mid-body portion more efficiently to reduce a potential for breakage of the driving surfaces during use.

22 Claims, 6 Drawing Sheets

METHODS AND APPARATUS FOR AN ENHANCED DRIVING BIT

BACKGROUND OF INVENTION

Presently fasteners are made with various recesses and matched driving tools, or bits, such as the Phillips® design, Torx®, straight walled hexagon, and other multi-fin geometries. Driving bits comprise driving walls and faces designed to fit within a recessed socket area of the fastener. However, to enable insertion of the driver into the recessed socket area, there must be some clearance between the driving tool and the recessed socket area of the fastener. As a result, the area of contact is typically less than full face-to-face contact between the driving tool and the recessed socket area of the fastener. In addition, the driving walls of the driving bit are longer than the recessed socket area of the fastener is deep such that a significant portion of the driving walls is not inserted into the recessed socket area. Consequently, when torque is applied by the driving bit to the fastener, the forces applied to the fastener head and driving walls are concentrated in localized stress regions. These localized stresses may lead to breakage of the bit. Efforts to increase the strength of the driving walls commonly focuses on the use of stronger materials or increasing the thickness of the driving walls. These efforts may provide some increased strength but the results are often limited due, at least in part, to size constraints of the related geometries.

SUMMARY OF THE INVENTION

Methods and apparatus for an enhanced driving bit according to various aspects of the present technology include a bit comprising a plurality of driving surfaces having a limited length and a shoulder portion positioned between the driving surfaces and a mid-body portion of the bit. The length of the driving surfaces is selected to allow complete insertion into a recessed socket area of a fastener such that the entire driving surface is positioned within the recessed socket area. The shoulder surface is configured to distribute localized stresses away from the driving surfaces to the mid-body portion more efficiently to reduce a potential for breakage of the driving surfaces during use.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various types of materials, fastening devices, driver systems and the like, which may carry out a variety of functions. In addition, the present technology may be practiced in conjunction with any number of processes such as the manufacture of drivers for fasteners, mechanical attachment, and torque transmitting systems, and the system described is merely one exemplary application for the invention. Further, the present technology may employ any number of conventional techniques for metalworking, component manufacturing, tooling fabrication, and/or forming surfaces.

Methods and apparatus for an enhanced driving bit according to various aspects of the present technology may operate in conjunction with any suitable torque delivery system. Various representative implementations of the present technology may also be applied to any device capable of being inserted into and rotating a fastener.

Figure 1:
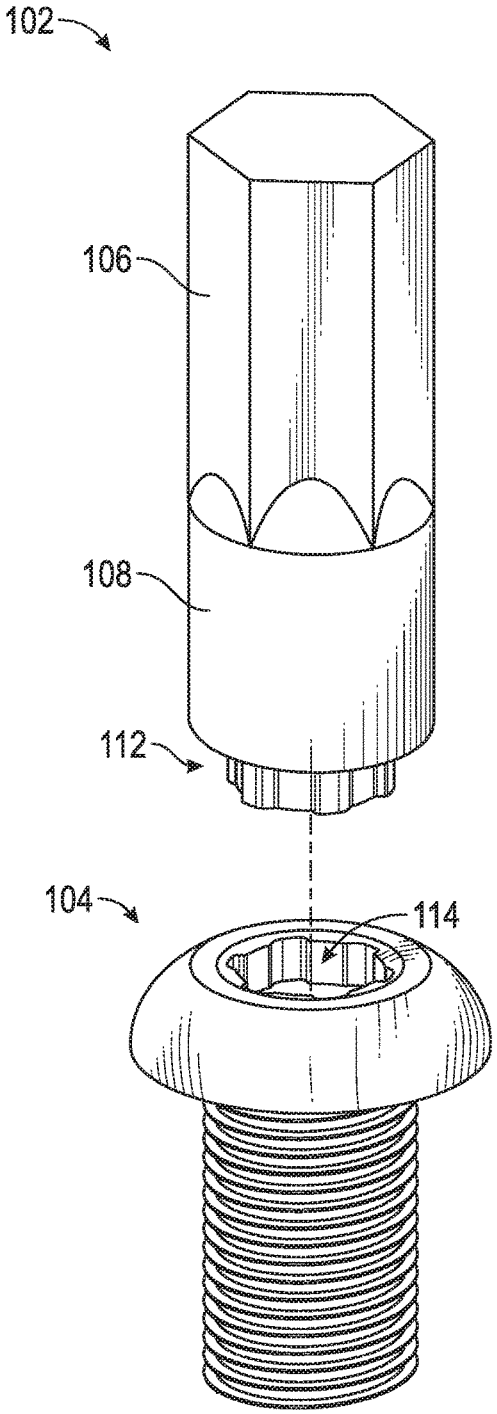
FIG. 1 representatively illustrates a perspective view of enhanced driving bit and a mating fastener in accordance with an exemplary embodiment of the present technology.

Referring now to FIG. 1, in an exemplary embodiment of the present technology, an enhanced driving bit may comprise a bit 102 comprising a body having a shank portion 106 at a first end, a mid-body section 108, and a driving portion 112 positioned at a second end. The bit 102 may comprise any suitable device or system for mating with the fastener 104 to facilitate a transfer of torque from the bit 102 to the fastener 104. For example, the bit 102 may comprise a multi-lobular surface configured to be selectively inserted into and conform to a recessed socket area 114 of the fastener 104 and engage an inner surface of the recessed socket area 114. The engagement between the bit 102 and the fastener 104 may create sufficient surface contact to couple the bit 102 and the fastener 104 together through a compressed or "stick fit" such that the fastener 104 does not fall off or otherwise automatically disengage from the bit 102 after the bit 102 has been inserted into the recessed socket area 114 of the fastener 104.

The bit 102 may comprise any suitable material capable of withstanding torque forces between the fastener 104 and the bit 102. For example, the bit 102 may comprise a metal or alloy that may be hardened or anodized. The material may also be capable of being subjected to one or more types of machining operations such as grinding, cutting, heading, hobbing, cold forming, or the like.

The shank portion 106 allows the bit 102 to be coupled to a device to allow the bit 102 to be rotated and apply a torque to the fastener 104. The shank portion 106 may comprise any suitable size or shape and may be configured in any suitable fashion. For example, in one embodiment, the shank portion 106 may comprise a series of sidewall elements forming hexagonal shape to allow the bit 102 to be selectively inserted into a receiving mechanism such as a chuck of a mechanical screw gun, drill, robotic arm, or the like. In an alternative embodiment, the shank portion 106 may comprise a circular shape suitably configured to be coupled to a handle to form a manually operated device such as a screw driver.

The mid-body section 108 extends at least part way between the shank portion 106 and the driving portion 112. The mid-body section 108 may be formed integrally with the shank portion 106 to create single unitary structure or may have a separate shape from the shank portion 106. For example, the bit 102 may be formed from a single metal rod, wherein the mid-body section 108 retains the original dimensions of the metal rod and the shank portion 106 is subjected to a machining operation to form a surface that may be used to couple the bit 102 to a device such as a drill or other like device that is configured to rotate the bit 102.

Figure 2:
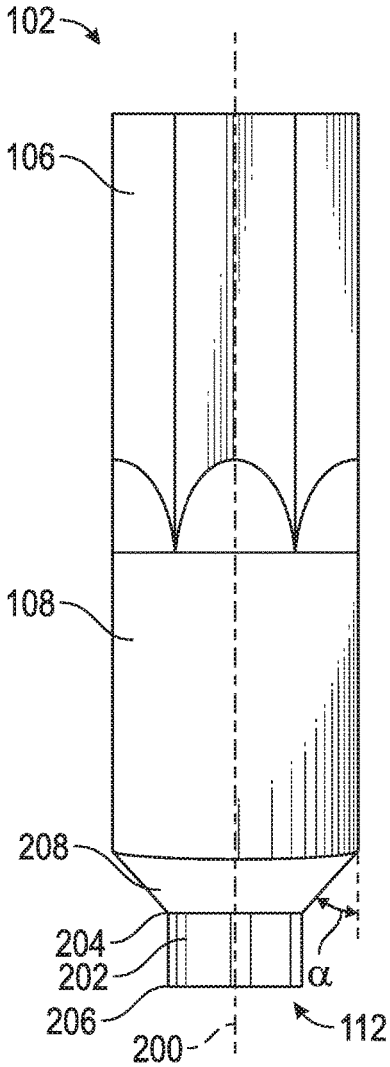
FIG. 2 representatively illustrates a side view of the enhanced driving bit in accordance with an exemplary embodiment of the present technology.

Referring now to FIG. 2, the driving portion 112 is configured to apply a torque force to the fastener 104 when the bit 102 is rotated. In one embodiment, the driving portion 112 may be adapted to provide a stick-fit when inserted into recessed socket area 114 such that the surface frictional forces between the driving portion 112 and the recessed socket area 114 of the fastener 104 are sufficient to couple the bit 102 and the fastener 104 together to allow single handed operation.

The driving portion 112 may comprise any suitable shape or size for engaging the recessed socket area 114 of the fastener 104. For example, the driving portion 112 may comprise a shoulder surface 208 extending longitudinally away from the mid-body section 108 and a torque surface 202 extending outwardly from the shoulder surface 208. The torque surface may be suitably configured to engage or otherwise substantially conform to a surface located within the recessed socket area 114.

The torque surface 202 may extend between a base portion 204 and an end portion 206. The torque surface 202 may be aligned substantially parallel to the shank portion 106 or the mid-body section 108. Alternatively, the torque surface 202 may taper towards a longitudinal axis 200 of the bit 102. A distance between the base portion 204 and the end portion 206 may comprise a length selected such that the entire torque surface 202 may be inserted into the recessed socket area 114 so that the shoulder surface 208 will abut the recessed socket area 114 and no portion of the torque surface 202 is positioned outside of the recessed socket area 114 when the bit 102 is used to torque the fastener 104. Limiting the length of the distance between the base portion 204 and the end portion 206 ensures that the entire length of the driving surface is in contact with the recessed socket area 114 and is being used to transfer a torque to the fastener 104. This substantially eliminates a situation where one portion of an individual torque surface 202 is applying a torque to the fastener 104 and a second portion of the individual torque surface 202 is not applying a torque because it is not in contact with the recessed socket area 114 of the fastener 104. For example, the torque surface a prior art style driver bit has a length greater than the recessed socket area 114 of a standard screw head resulting in the torque surface the prior art style driver bit extending outward beyond the top of the screw head.

For example, in one embodiment, the distance between the base portion 204 and the end portion 206 may be less than two tenths of an inch when the recessed socket area 114 has a depth of about two tenths of an inch. In a second embodiment, the distance between the base portion 204 and the end portion 206 may be less than about five one hundredths of an inch when the recessed socket area 114 has a depth of between about five one hundredths of an inch and seven one hundredths of an inch.

Figure 8:
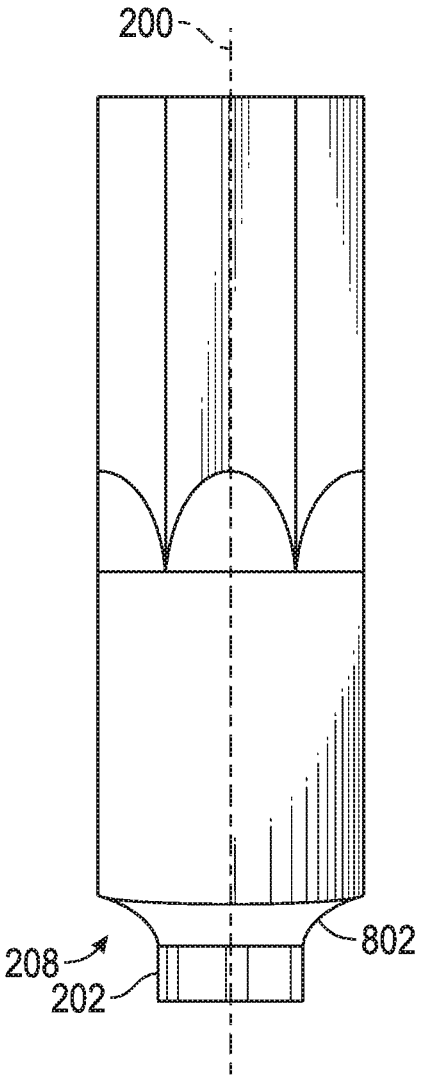
FIG. 8 representatively illustrates a convex shoulder portion in accordance with an exemplary embodiment of the present technology.
Figure 9:
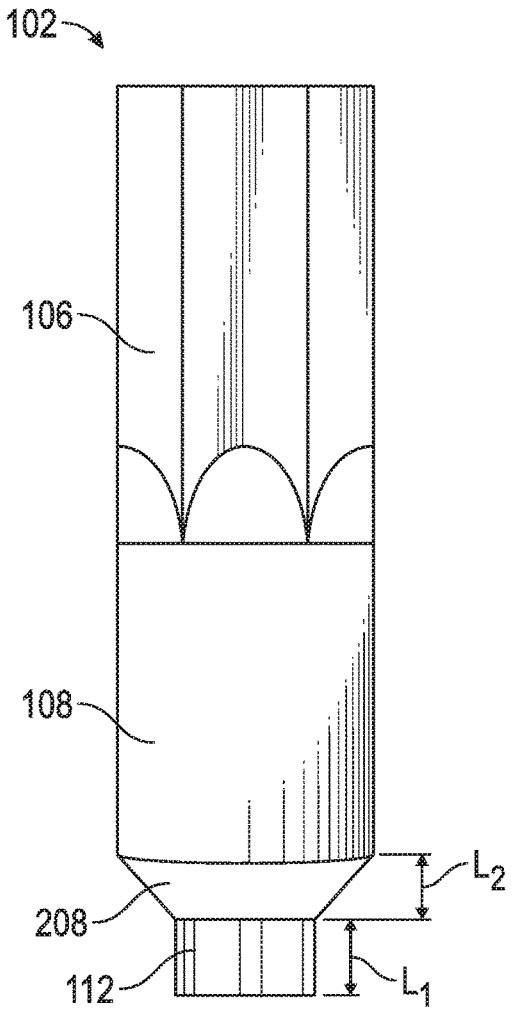
FIG. 9 representatively illustrates a side view of the enhanced driving bit in accordance with an exemplary embodiment of the present technology.

In alternative embodiments, the distance between the base portion 204 and the end portion 206 may be determined according to a relationship between a length of the driving portion 112 and the shoulder surface 208. Referring now to FIG. 8, in one embodiment, the distance between the base portion 204 and the end portion 206 may comprise a length $L_1$ and the shoulder surface 208 may comprise a length $L_2$. $L_1$ may comprise a length at least as long as one-half of $L_2$ but not greater than twice $L_2$. For example, in one embodiment, $L_1$ may comprise a length between about one and one and one-half times that of $L_2$. Limiting the length of $L_1$ helps to ensure that the driving portion 112 may be fully inserted into the recessed socket area 114 of the fastener 104.

Figure 3:
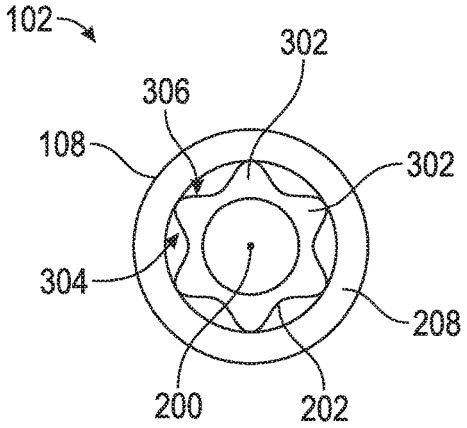
FIG. 3 representatively illustrates an end view of the enhanced driving bit having conventional Torx® style driving surfaces in accordance with an exemplary embodiment of the present technology.
Figure 4:
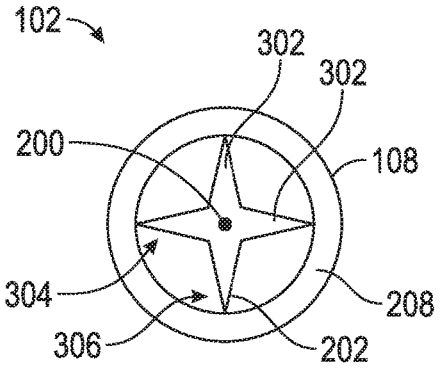
FIG. 4 representatively illustrates an end view of an alternative embodiment of the enhanced driving bit having four driving surfaces in accordance with an exemplary embodiment of the present technology.
Figure 5:
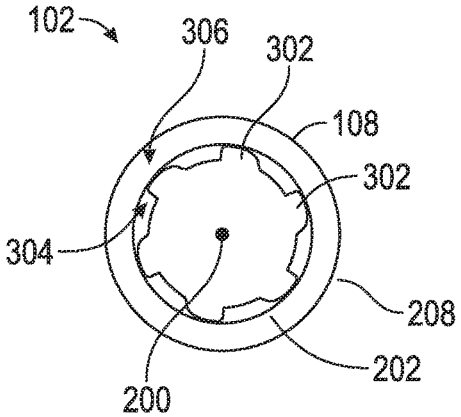
FIG. 5 representatively illustrates an end view of an alternative embodiment of the enhanced driving bit having six symmetrical driving surfaces in accordance with an exemplary embodiment of the present technology.
Figure 6:
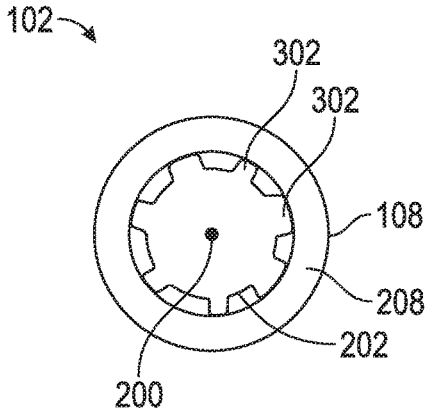
FIG. 6 representatively illustrates an end view of a second alternative embodiment of the enhanced driving bit having six nonsymmetrical driving surfaces in accordance with an exemplary embodiment of the present technology.

Referring now to FIGS. 3 and 4, the torque surface 202 may further comprise a plurality of fins 302 that project outwardly from the longitudinal axis 200. The plurality of fins may comprise any number and may be determined according to a particular type of fastener that the torque surface 202 is intended to engage. For example, the plurality of fins 302 may be oriented equidistantly around the longitudinal axis 200 and be suitably configured to engage standard Torx® and Phillips® style fasteners. Alternatively, and referring now to FIG. 5, the plurality of fins 302 may be spaced equidistantly around the longitudinal axis 200 and be configured with a customized geometry. In yet another embodiment and referring now to FIG. 6, the plurality of fins 302 may be oriented around the longitudinal axis 200 with a nonsymmetrical spacing between each individual fin from among the plurality of fins 302. The number of fins 302 shown in FIGS. 3-6 is representative illustrations only. In practice, the number of fins 302 making up the torque surface 202 may comprise any suitable number and may be determined according to any suitable criteria. For example, a customized bit 102 for use with a security fastener may comprise up to ten fins 302 and be arranged symmetrically or nonsymmetrically around the longitudinal axis 200.

Each fin 302 may comprise a driving wall 304, a removal wall 306, and a first transition wall extending between the driving wall 304 and the removal wall 306. The torque surface may also comprise a second transition wall extending between the driving wall 304 of a first fin and the removal wall 306 of a second fin. Each of these walls may be suitably configured to mate to a corresponding surface within the recessed socket area 114 of the fastener 104. For example, the driving wall 304 may comprise a constant fin height from the base portion 204 to the end portion 206 that equals a height of a corresponding driving surface within the recessed socket area 114. In addition, the driving wall 304 may be configured to be aligned with the axis 200 of the bit 102 such that there is substantially complete face-to-face contact between the driving wall 304 and the driving surface within the recessed socket area 114 during engagement. This allows the driving force to be spread across a larger area than is achievable through known fastener systems that only provide localized contact between the driving surface and a corresponding surface within the fastening device.

Similarly, the removal wall 306 may be configured to have the same dimensions as the removal surface 212 such that there is substantially complete face-to-face contact between the removal wall 306 and a corresponding removal surface within the recessed socket area 114 during engagement. For example, in one embodiment, the removal wall 306 may form a substantially mirror image of the driving wall 304.

Alternatively, in a second embodiment, the removal wall 306 may form a non-vertical line relative to the axis 200 of the bit 102 as it extends from the base portion 204 to the end portion 206 in an equivalent manner to the removal surface. The non-vertical line may lie on an angle that causes the first transition wall to become progressively smaller as it descends toward the end portion 206. Likewise, as the driving wall 304, the removal wall 306, the first transition wall, and a second transition wall progress to the end portion 206 of the torque surface 202, each surface may taper inwardly towards the axis 200 such that the polygonal shape of the fins have a smaller area at the end portion 206 than at the base portion 204. The end result is that the torque surface 202 tapers the same in every dimension as the recessed socket area 114 and is the same size at every corresponding position to the recessed socket area 114. Accordingly, when the bit 102 is inserted into the recessed socket area 114, the entire the torque surface 202 is in contact with every surface of the recessed socket area 114 both longitudinally and horizontally. The similar geometry allows the torque surface 202 to be wedged into the recessed socket area 114 to create a substantially 100% wedged fit between the bit 102 and the fastener 104 in all directions and with no portion of the torque surface 202 extending out of the recessed socket area 114.

This wedged fit may further align the bit 102 and the fastener 104 during use by reducing tolerances between the torque surface 202 and the recessed socket area 114. Reduced tolerances may result in a decreased likelihood that the bit 102 may wobble within the recessed socket area 114 when the driving force or removal force is being applied which reduces the chances of cam out and/or disengagement. The wedge fit during use may also decrease plastic deformation on the driving wall 304 and the removal wall 306 which results in decreased wear on the torque surface 202 and the recessed socket area 114.

Figure 10:
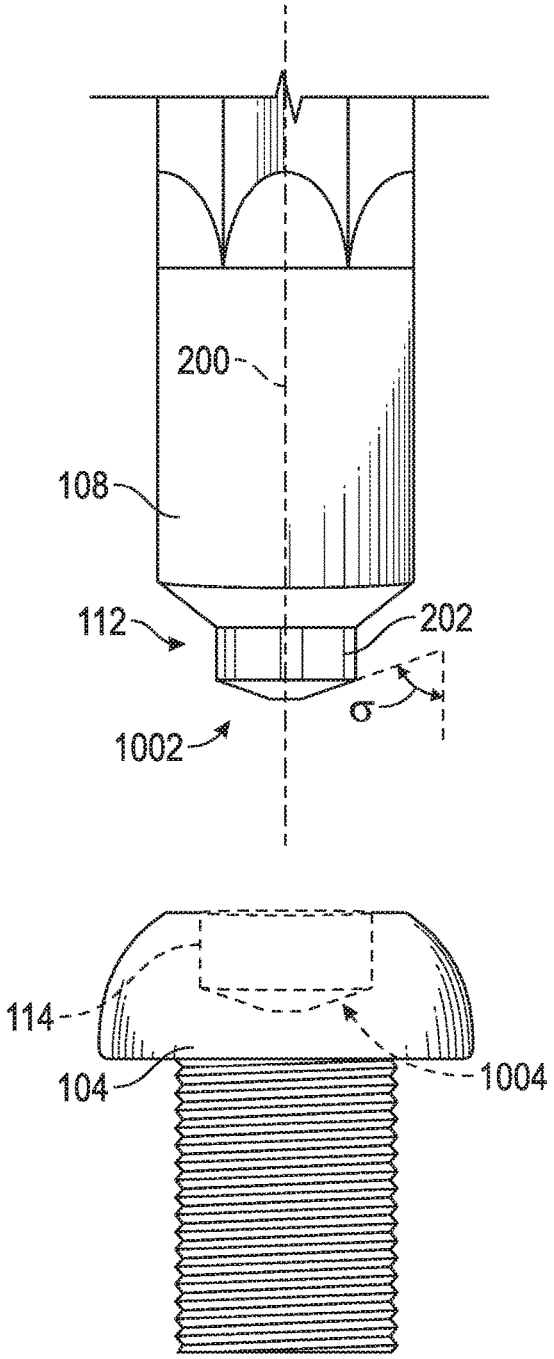
FIG. 10 representatively illustrates a side view of the enhanced driving bit including a tapered nose section and a mating fastener with a tapered receiving section in accordance with an exemplary embodiment of the present technology.

Referring now to FIG. 10, the driving portion 112 may further comprise a tapered nose section 1002 extending outwardly away from the torque surface 202 and towards the longitudinal axis 200 by an angle $\sigma$ of between about sixty degrees and about seventy-five degrees relative to a sidewall of the mid-body section 108. The tapered nose section 1002 may be configured to fit into a mating recess 1004 in the recessed socket area 114. For example, in one embodiment, the angle $\sigma$ may be equal to about seventy degrees to allow the tapered nose section 1002 to conform to a taper of the same amount present in a screw head.

The tapered nose section 1002 may help center the torque surface 202 during insertion or allow the torque surface 202 of a customized bit to be indexed more easily to a correct position and provide complete insertion of the driving portion 112 into the recessed socket area 114. The tapered nose section 1002 may also allow for improved engagement between the torque surface 202 and the fastener 104 be reducing or eliminating a radius at an end of the torque surface 202. For example, standard flat nosed driver bits often comprise a radius of at least 0.020 inches at the tip that prevents the driver bits from getting full engagement at insertion depth.

Figure 11:
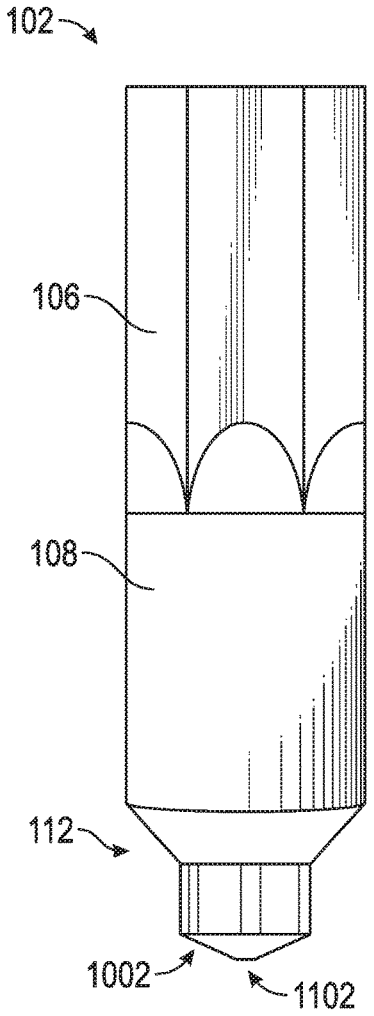
FIG. 11 representatively illustrates a side view and bottom view of the enhanced driving bit including an extended tapered nose section in accordance with an exemplary embodiment of the present technology.
Figure 11:
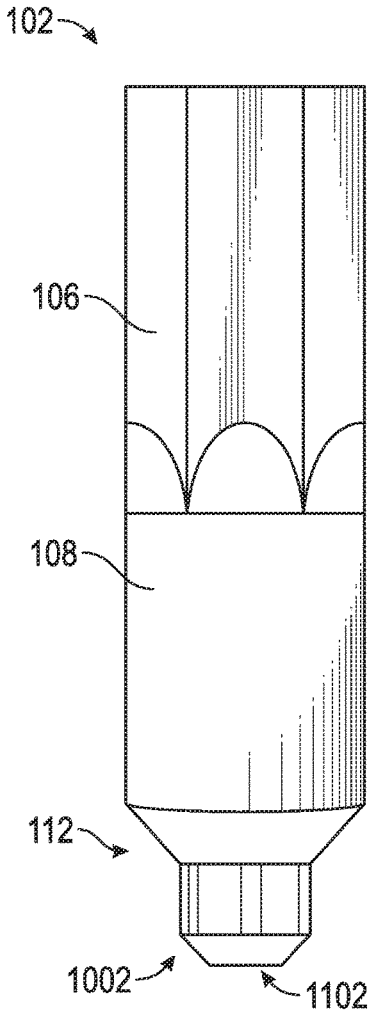
Figure 11:
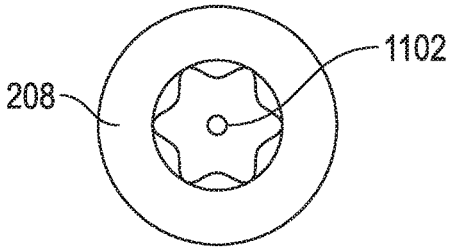
Figure 12:
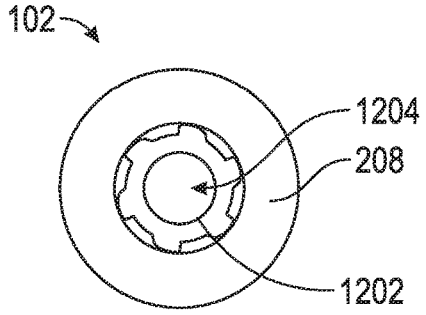
FIG. 12 representatively illustrates a side view and bottom view of the enhanced driving bit including a shortened tapered nose section in accordance with an exemplary embodiment of the present technology.

The tapered nose section 1002 may be formed in any suitable manner to allow for a tip of the driving portion 112 to be adapted to various types of recessed socket areas 114. For example, referring now to FIG. 11, in one embodiment the tapered nose section 1002 may extend almost to a pointed tip 1102 that may only comprise a slightly blunted or flat surface that is suitably configured to reach all the way down to the bottom of the recessed socket area 114. Referring now to FIG. 12, in an alternative embodiment, the tapered nose section 1002 may be formed to accommodate a security pin (not shown) positioned within the recessed socket area 114. For example, the tapered nose section 1002 may comprise a shortened length that results in a larger and more blunt tip 1202 with respect to that shown in FIG. 10. The blunt tip 1202 allows for an opening 1204 to be positioned within the driving portion 112 that may receive the security pin.

In prior art driver bits, the transition between the torque surface 202 and the mid-body section 108 is abrupt commonly forms a substantially ninety degree angle. The abrupt transition creates a location of increased stress that increases a likelihood that one or more fins of the torque surface 202 will break during use since the torque forces are not efficiently transferred from the driving portion 112 to the mid-body section 108 of the bit 102.

Referring again to FIG. 2, to reduce the potential for breakage of the torque surface 202, the shoulder surface 208 is positioned between the mid-body section 108 and the base portion 204 of the driving portion 112 to help distribute torque forces away from the torque surface 202 by creating a more gradual transition between the mid-body section 108 and the driving portion 112. The shoulder surface 208 may comprise any suitable shape or size for reducing localized stress regions on the driving portion 112 to reduce a potential for the fins to break during use. For example, the shoulder surface 208 may comprise a surface tapering towards the longitudinal axis 200 by an angle $\alpha$ of between about thirty degrees and about eighty degrees relative to a sidewall of the mid-body section 108.

Figure 7:
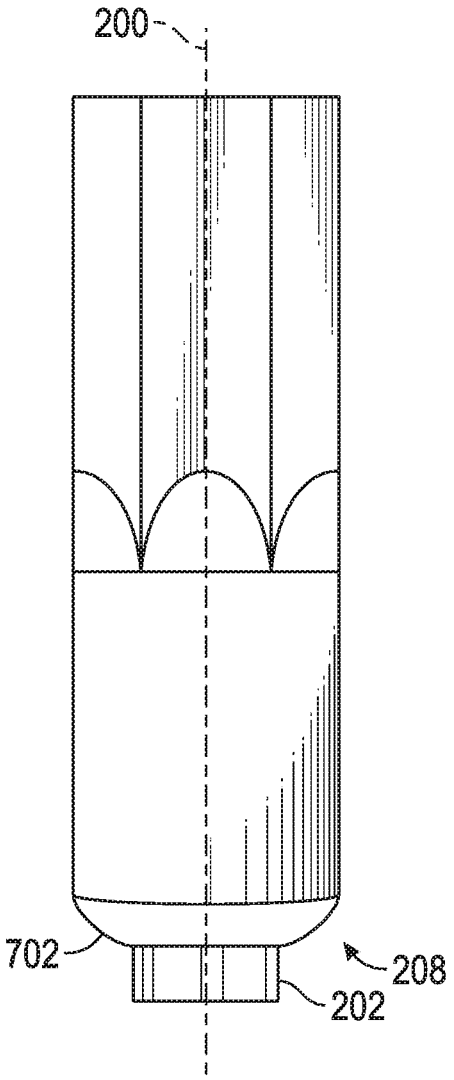
FIG. 7 representatively illustrates a concave shoulder portion in accordance with an exemplary embodiment of the present technology.

Referring now to FIG. 7, in an alternative embodiment, the shoulder surface 208 may comprise a curved surface 702, or bullnose, that tapers towards the longitudinal axis 200. The curved surface may be slightly convex and be configured to intersect each of the mid-body section 108 and the base portion 204 at an angle other than ninety degrees. Referring now to FIG. 8, in yet another embodiment, the shoulder surface 208 may comprise a curved concave surface 802 that tapers towards the longitudinal axis 200 and is configured to intersect each of the mid-body section 108 and the base portion 204 at an angle other than ninety degrees.

By shortening the length of the driving portion 112 to ensure full insertion into the recessed socket area 114 and incorporating the shoulder portion, overall strength of the driver bit 102 is increased and the likelihood of fin or torque surface 202 breakage is reduced. For example, in testing, a prior art Torx® style driver bit was inserted into a fastener head and torqued until the torque surface 202 broke. During testing, the prior art driver bit broke when subjected to approximately fifty-five to sixty inch pounds of torque. A driver bit 102 of the present technology was then subjected to the same testing and broke at approximately ninety-five to one hundred five inch pounds of torque. Similar increases in strength were found in other styles of driver bits evidencing the benefits of the reduce length of the driving portion 112 and the incorporation of the shoulder surface 208 between the driving portion 112 and the mid-body section 108.

Figure 13:
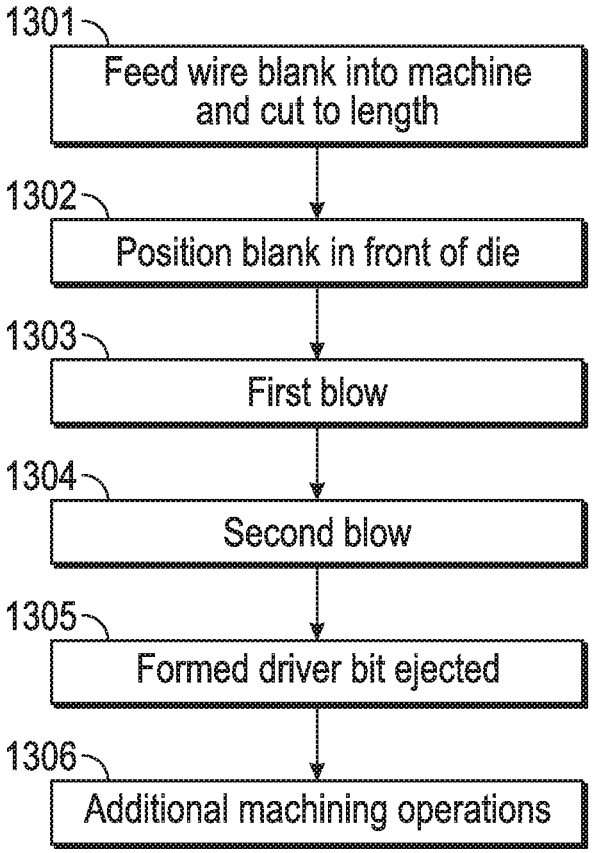
FIG. 13 is a flow chart for forming a driving bit in accordance with an exemplary embodiment of the present technology.

The shoulder surface 208 and the driving portion 112 may be formed by any suitable method such as by forming, forging, casting, cutting, grinding, milling, and the like. In one embodiment, the shoulder surface 208 and the driving portion 112 may be formed through a metal operation such as cold heading or hobbing. For example, referring now to FIG. 13, a wire blank may be fed into a heading machine and cut to a predetermined length (1301). The wire blank may then be positioned in front of a die (1302). The wire blank may then be forced into the die in a first blow forming an intermediate shape (1303). A second blow may be applied to the intermediate shape with a hammer that is suitably configured to form the torque surfaces 202 of the driving portion (1304). The bit 102 may then be ejected from the header machine (1305) and moved to a subsequent machining operation such as to form the shoulder surface 208 and the shank portion 106 (1306).

In an alternative embodiment, the shoulder surface 208 and the driving portion 112 may be formed through a series of computerized numerical controlled ("cnc") machining steps. For example, the torque surface 202 may initially be milled on an end portion of a metal rod. The metal rod may then be positioned within a lathe to form the shoulder surface 208 and the tapered nose section 1002.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A driver bit for a fastener, comprising:
- a body having:
  - a shank portion at a first end of the body;
  - a mid-body section extending from the shank portion;
  - a driving portion extending from the mid-body section to a second end of the body, wherein the driving portion comprises:
    - a shoulder surface tapering from the mid-body portion towards a longitudinal axis of the body by an angle between about thirty degrees and about eighty degrees relative to a sidewall of the mid-body portion; and
    - a plurality of driving surfaces extending along the longitudinal axis from the shoulder surface to the second end of the body, wherein the plurality of driving surfaces comprise a length of less than two tenths of an inch.

2. A driver bit according to claim 1, wherein the shoulder surface tapers along a substantially linear path from the mid-body portion to the plurality of driving surfaces.

3. A driver bit according to claim 1, wherein the shoulder surface tapers to form a substantially convex surface from the mid-body portion to the plurality of driving surfaces.

4. A driver bit according to claim 1, wherein the shoulder surface tapers to form a substantially concave surface from the mid-body portion to the plurality of driving surfaces.

5. A driver bit according to claim 1, wherein the plurality of driving surfaces comprise four fins spaced equidistantly around the longitudinal axis.

6. A driver bit according to claim 1, wherein the plurality of driving surfaces comprise six fins spaced equidistantly around the longitudinal axis.

7. A driver bit according to claim 1, wherein the plurality of driving surfaces taper towards the longitudinal axis.

8. A driver bit according to claim 1, wherein each of the plurality of driving surfaces are parallel with respect to each other.

9. A driver bit according to claim 1, wherein the driving portion further comprises a tapered nose section extending outwardly away from the plurality of driving surfaces and towards the longitudinal axis by an angle of between about sixty degrees and about seventy-five degrees relative to a sidewall of the mid-body section.

10. A driver bit for a fastener, comprising:
- a body having:

a shank portion at a first end of the body;

a mid-body section extending from the shank portion;

a driving portion extending from the mid-body section to a second end of the body, wherein the driving portion comprises:

a shoulder surface tapering from the mid-body portion towards a longitudinal axis of the body by an angle between about thirty degrees and about eighty degrees relative to a sidewall of the mid-body portion to form a first length; and a plurality of driving surfaces extending along the longitudinal axis from the shoulder surface to the second end of the body, wherein the plurality of driving surfaces comprise a second length of between about one-half and one and one-half times that of the first length.

11. A driver bit according to claim 10, wherein the shoulder surface tapers along a substantially linear path from the mid-body portion to the plurality of driving surfaces.

12. A driver bit according to claim 10, wherein the shoulder surface tapers to form a substantially convex surface from the mid-body portion to the plurality of driving surfaces.

13. A driver bit according to claim 10, wherein the shoulder surface tapers to form a substantially concave surface from the mid-body portion to the plurality of driving surfaces.

14. A driver bit according to claim 10, wherein the plurality of driving surfaces comprise four fins spaced equidistantly around the longitudinal axis.

15. A driver bit according to claim 10, wherein the plurality of driving surfaces comprise six fins spaced equidistantly around the longitudinal axis.

16. A driver bit according to claim 10, wherein the plurality of driving surfaces taper towards the longitudinal axis.

17. A driver bit according to claim 10, wherein each of the plurality of driving surfaces are parallel with respect to each other.

18. A driver bit according to claim 10, wherein the driving portion further comprises a tapered nose section extending outwardly away from the plurality of driving surfaces and towards the longitudinal axis by an angle of between about sixty degrees and about seventy-five degrees relative to a sidewall of the mid-body section.

19. A method of forming a driver bit, comprising:

forming a drive for a hammer, wherein the drive comprises:

a plurality of driving surfaces extending from an end of the body along a longitudinal axis of the drive, wherein each of the plurality of driving surfaces comprises a length of less than about two tenths of an inch; and a shoulder surface tapering from plurality of driving surfaces away from the longitudinal axis of the drive by an angle between about sixty degrees and about eighty degrees relative to a sidewall of the drive;

coupling the drive and hammer to a header machine;

cutting a wire blank to a pre-determined length;

positioning the cut wire blank adjacent to a die;

heating the cut wire blank; and inserting the heated wire blank into the drive in a blow from the header machine, wherein the drive forms the driving portion.

20. A method according to claim 19, wherein the drive further comprises a tapered nose section.

21. A method according to claim 19, further comprising forming a shank portion on the driver bit, wherein the shank portion is at an opposite end of the wire blank as the driving portion.

22. A method according to claim 19, further comprising forcing the wire blank into the die with an upset tool in a first blow from the header machine to form an intermediate shape out of the wire blank prior to completing the head portion, wherein the intermediate shape comprises an unfinished head portion and a shank portion.

* * * * *